US006336246B1

(12) United States Patent
Giovannetti

(10) Patent No.: US 6,336,246 B1
(45) Date of Patent: Jan. 8, 2002

(54) DOOR MOUNTING MECHANISM AND ASSEMBLY FOR DOOR OPENING-CLOSING WITH MOVEMENTS AT RIGHT ANGLES

(76) Inventor: Antonio Giovannetti, Residenza Fontana, Milan 2, 20090 Segrate (Milan) (IT)

( * ) Notice: Subject to any disclaimer, the term of this patent is extended or adjusted under 35 U.S.C. 154(b) by 0 days.

(21) Appl. No.: 09/531,173

(22) Filed: Mar. 21, 2000

(30) Foreign Application Priority Data

Mar. 26, 1999 (IT) ..... MI99A0631

(51) Int. Cl.[7] ..... E05D 15/10

(52) U.S. Cl. ..... 16/87 R; 49/128; 49/130; 312/295

(58) Field of Search ..... 16/87 R, 87 B; 49/125, 128, 127, 129, 130; 312/295, 310

(56) References Cited

U.S. PATENT DOCUMENTS 4,551,945 A * 11/1985 von Resch ..... 49/130
4,644,690 A * 2/1987 Caimi ..... 49/130
4,669,219 A * 6/1987 Tomida ..... 49/130
4,752,106 A * 6/1988 Salvarani ..... 49/130
4,794,730 A * 1/1989 Fischbach ..... 49/130
4,802,307 A * 2/1989 Schmidt ..... 49/130
4,829,710 A * 5/1989 Schmidt ..... 49/125
4,845,891 A * 7/1989 Fischbach ..... 49/129

* cited by examiner

*Primary Examiner*—Lynne H. Browne
*Assistant Examiner*—Doug Hutton
(74) *Attorney, Agent, or Firm*—Jacobson Holman, PLLC

(57) ABSTRACT

A mounting mechanism for coplanar doors is of a four-bar linkage type and a door is carried on parallel links or connecting rods, so that it moves parallel to itself from a steady, closed position, through a transitory retracted or extracted position, to an opening position, before or behind another door, and vice-versa. The connecting rods are carried on a sliding carriage unit and a cam compensator unit is provided that ensures carriage movement parallel to a door plane, for part of the way, when the door is moved between its closed position and a retracted or extracted intermediate position, by rotation of the connecting rods, so that the resultant door movement is basically at right-angles to the door plane.

10 Claims, 6 Drawing Sheets

DOOR MOUNTING MECHANISM AND ASSEMBLY FOR DOOR OPENING-CLOSING WITH MOVEMENTS AT RIGHT ANGLES

DESCRIPTION

The invention applies to the field of furniture.

So-called coplanar door units are well known and widely used for closing openings on furniture or as doors used in various living environments. Coplanar doors, when in a closing position, generally have their main surfaces lying on a same vertical plane and opening of a passageway closed by the doors is carried out by pushing back one of the doors and therefore sliding it behind a second door which remains stationary, or vice versa by drawing or pulling one of the doors and sliding it over the other door which remains temporarily stationary. Movement may be applied to either of the coplanar doors. For aesthetic and practical reasons it is desired that each door is kept parallel to itself in its closing position, in its intermediate retracted or extracted position, and in its opening position n when it overlaps a second door.

A coplanar door movement mechanism of four-bar linkage type is already known. This mechanism includes a carriage movable for a horizontal traverse parallel to the door plane, and two parallel connecting rods or links assembled on the carriage and supporting a door. To open the door, the user pushes it from its steady closed position to its retracted (respectively extracted) intermediate position, then slides it behind or before, respectively, a second door held stationary. Since, during a first movement step, the carriage stays still, the first door, passing from its steady closed position to its retracted or respectively extracted position, moves along a circular are round the connecting rod fulcrums on the carriage. Such are motion, although of limited extent, is undesirable since it means that a relatively wide clearance is needed between a door's vertical edge and a fixed structure facing it, and because it means that a door must be bevelled so as not to interfere with an adjacent door.

An aim of the invention is to achieve an opening/closing coplanar door movement that produces a straight shifting of the door between its closing position and its intermediate retracted or extracted position and vice versa, i.e. in which each vertical door edge substantially moves in a plane.

An additional aim is to realize such a device that keeps the door parallel to itself in every position.

An additional aim of the invention is to realize a device of limited bulk, that may be hidden from view by the furnishing portions whereon it is assembled and that is easy to assemble as a single item.

Such aims have been reached with a mechanism as said in claim 1 and an assembly as said in claim 10. Additional new and useful characteristics are said in the following claims.

The mechanism of the invention includes a pair of levers or connecting rods arranged as a four-bar linkage, each assembled by a pivot on a sliding carriage, and a compensator unit to make the carriage slide, each time the connecting rods are rotated to retract or extract the door, carried on them, by an extent that is equal and opposite to the extent of the projection, on a carriage track, of an arc travelled by the door. The compensator unit is generally of cam type. More particularly, the compensator unit includes at least a slider which is moved by a tab extending from a connecting rod of the four-bar linkage, each connecting rod forming a first class lever. The slider is longitudinally movable along the carriages for a length and at one end thereof has a movement control lever engaging a cam recess in a mechanism stationary structure with a cam roller. A spring between the slider and the carriages biases the mechanism to its stable condition with the connecting rods or links in a condition in which the door is in the closing position. The mechanism can be enclosed in a thin casing that internally forms a cam part and the sliding track for the carriages.

Each door is preferably assembled on a said mechanism at its upper edge and on another said mechanism at its lower edge, the carriage unit of the mechanism preferably occupying a lengthwise extension of no more than half the door width. Preferably the upper and lower mechanismns are interconnected with at least one bar which is rigidly secured to a connecting rod of the upper mechanism and a corresponding connecting rod of the lower mechanism to ensure a consistent shifting of both mechanisms and a door movement wherein the door is always parallel according to vertical planes.

The new device achieves the above mentioned aims, particularly allows each door of a set of coplanar doors to move parallel to itself along perpendicular axes. Moreover, it is of compact construction. It could be entirely factory built, with only simple mounting operations required for assembly to a door and the item of furniture or the structure of which the door is part.

An exemplary unrestrictive embodiment of the invention will be described in the following with reference to the enclosed figures in which.

Figure 1:
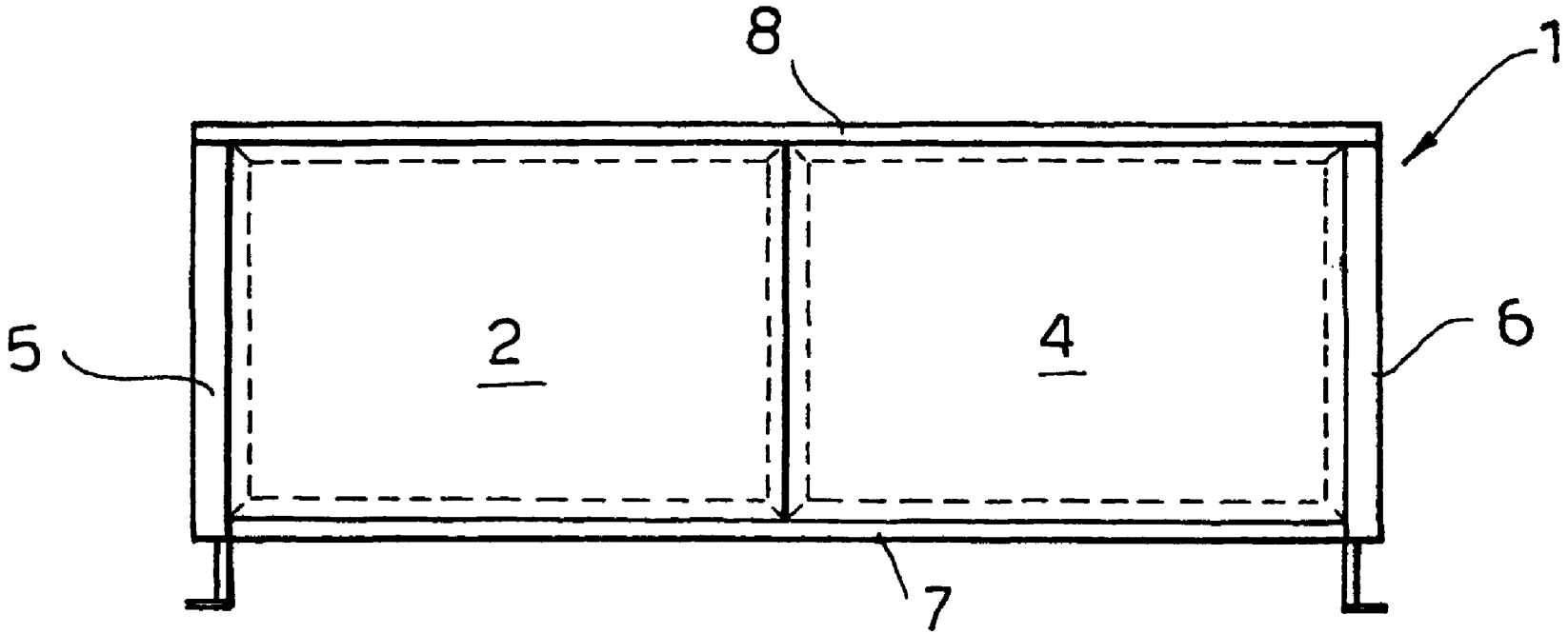
FIG. 1 is a front elevational view of a coplanar door item of furniture, drawn in a reduced scale.
Figure 2:
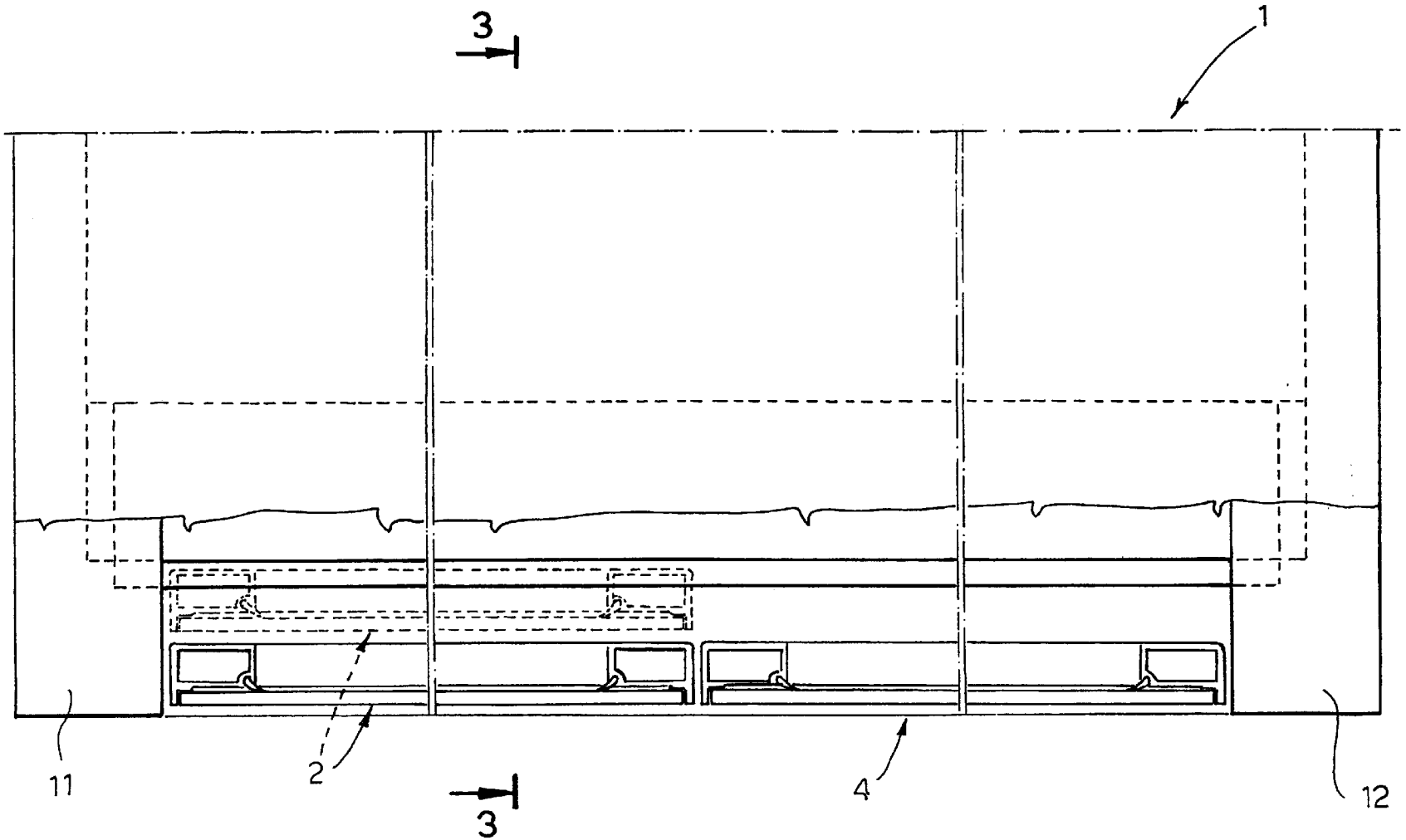
FIG. 2 is a broken-away, top plan view of the item of furniture in FIG. 1, with a covering plate partially removed, and shown enlarged with respect to FIG. 1; the doors thereof are drawn with a continuous line in their coplanar closing position, a door is drawn in dash lines in an intermediate retracted position, ready to be moved sideways for opening.

With reference to first FIG. 1, a pair of coplanar doors is shown fitted to an item of furniture or wardrobe. The item of furniture is referenced 1 as a whole and the doors have the references 2 and 4. The exposed faces of doors 2 and 4 lie on a same vertical plane when the doors are in a position in which they cooperate to close a front opening of the piece of furniture or wardrobe.

Although the explanation given here, as an example, refers to wardrobe doors, the use of coplanar door pairs to close openings or passageways of different kinds is known.

Figure 3:
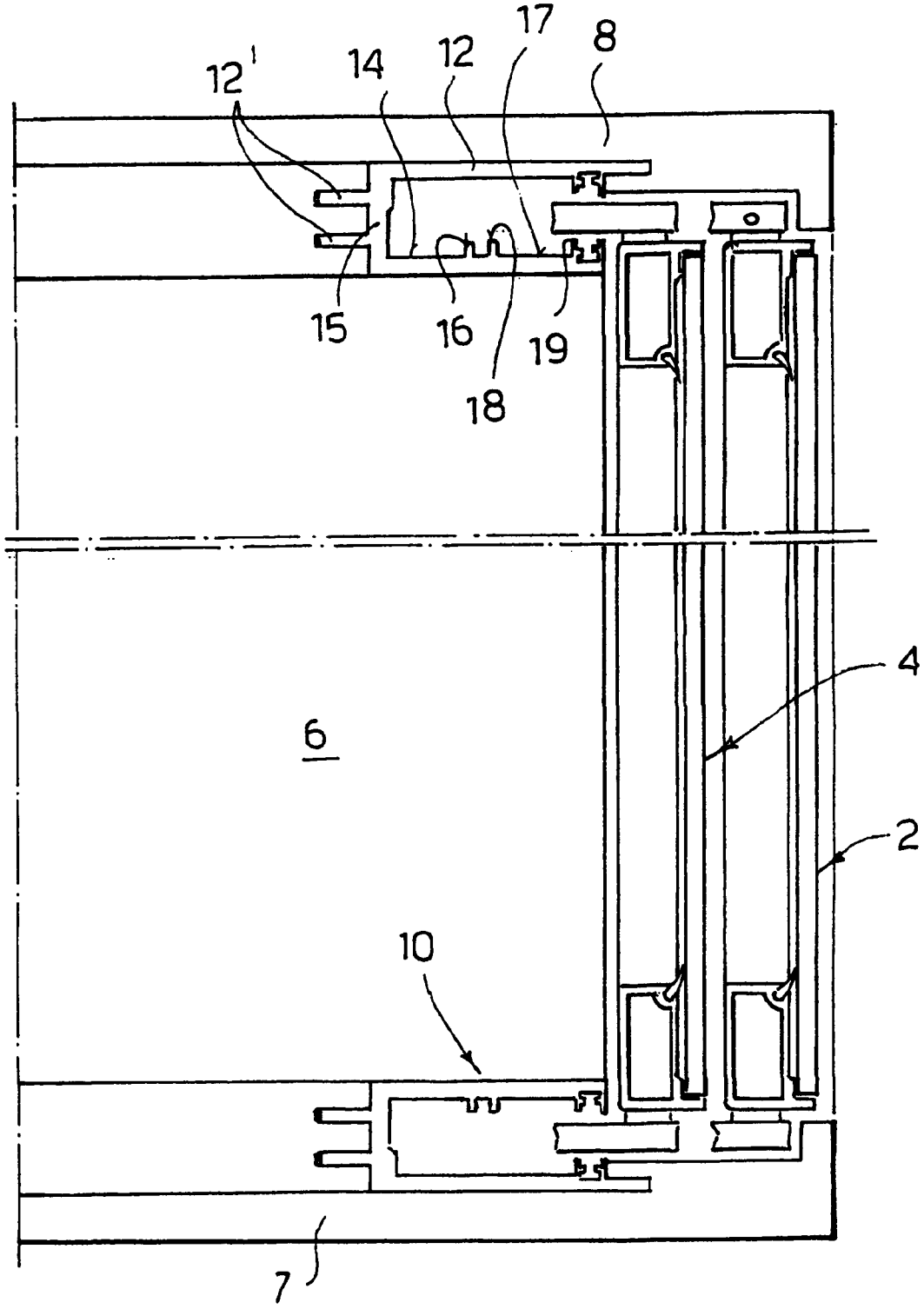
FIG. 3 is a vertical sectional view along 3—3 in FIG. 2; the doors are shown in an opening position, in which one of the doors is moved behind the other.

Wardrobe 1 basically includes lateral uprights 5, 6, a base panel 7, a covering or upper panel 8. The coplanar doors 2 and 4 are assembled to close a front opening defined by panels 5, 6, 7 and 8. A movement mechanism or device for the doors, according to the invention, is referenced 10 in the figures. As shown in FIG. 3, a mechanism 10 is assembled on top of, and a mechanism 10 at the bottom of panel 8 and panel 7, respectively.

Figure 4:
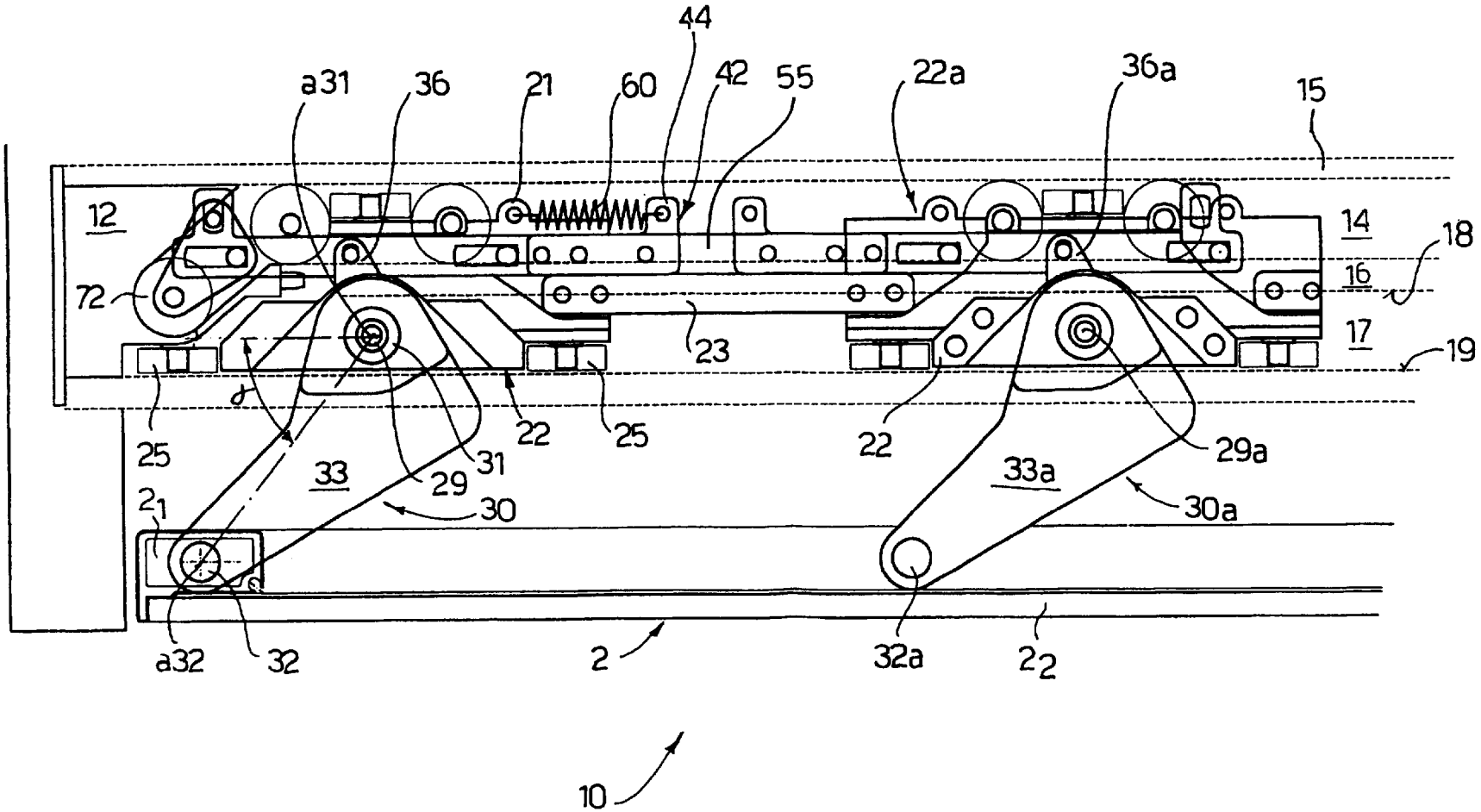
FIG. 4 is a top plan view of the invention mechanism; the mechanism is shown in an embodiment thereof suitable for assembly of a lefthand door of a coplanar door pair and is shown in its stable closing position; an upper plate of a mechanism casing has been removed to expose the underlying parts.

The device or mechanism 10 will be explained in detail with reference to FIGS. 4, 5, and 6. With reference first to FIG. 4, a door 2 is shown interrupted in its closing position. Said door includes a peripheral frame 2, and, on an exposed part thereof, a panel 22. However, the invention is also applicable to solid wooden doors. The mechanism 10 includes a fixed box-like structure or casing 12, that has a C-shape in sectional view as seen in FIG. 3, and internally forms a first and second sliding track, 14 and 17, horizontally extended and parallel along the width of the opening to be closed by the doors. Track 14 is defined by walls 15, 16, of which 16 is of reduced height. A second track 17 is defined between walls 18 and 19 of reduced height. The tracks can be defined in the internal lower surface of the box-like structure 12 or in the upper surface thereof, or both.

The box-like structure 12 further has coupling means 12' for coupling to the panel, in any form.

The mechanism 10 includes a carriage unit 20, comprising a pair of carriages 22, 22*a*, made integral with each other by a rod 23. The carriage unit length preferably does not exceed half the door width. Since the two carriages 22, 22*a* are preferably identical, a description of only one of them will follow, since such a description is also applicable to the other (the parts of which are denoted by reference numbers corresponding to those of the corresponding parts of the first carriage with the letter a, and they will not be described). Carriage 22 has a pair of vertical axis movement guide wheels 24, 24 and horizontal axis movement guide wheels 25, 25 on one side and 26 on the other side. Wheel 26 is preferably arranged between the two wheels 24. This arrangement provides for travel of carriage 22 alone the longitudinal direction (the direction of the opening width), with wheels 24, 26 engaging track 14, wheels 25 engaging track 17. The carriage has a seat 28, defining an axis 29 whereon a connecting rod or lever element 30 is rotatably assembled with an eyelet or bearing 31 thereof. Lever 30 and lever 30*a* are pivoted with their other respective distal pivots 32, 32*a* of arms 34, 34*a* on door frame $\mathbf{2}_1$. Each carriage can be completed with a covering plate 34, 34*a* that is assembled to cover the respective carriage seat 28, 28*a*.

From lever 30, respectively 30*a* in opposite position to arm 33, respectively 33*a* with respect to the fulcrum of 31 (31*a*) i.e. axis 29, 29*a*, extends a tab 36, 36*a* which will be discussed later.

A compensator unit referenced 40 as a whole includes a pair of sliders, 42 and 42*a*, respectively. The sliders 42, 42*a* are preferably identical, are made of cut metal sheet, and are symmetrically arranged with respect to a vertical plane (FIG. 6). Only slider 42 will be described, and the description there of also o applies to slider 42*a*, whose elements carry corresponding references to those of slider 42, but with the letter a. The slider 42 (42*a*) is bar-shaped and has two end lugs 45 (45*a*) and 46 (46*a*), respectively. Lug, 45, (respectively 45*a*) has an elongated slot 47, respectively 47*a*, lug 46, 46*a* has through hole 48, respectively 48*a*. A left end (in the figures) of slider 42 (42*a*) has an elongated slot 50 (50*a*). In it s intermediate position the slider has a through hole 51 (51*a*) and an additional elongated slot 52 (52*a*) and further through holes 53 (53*a*). The two sliders 42, 42*a* are made integral to each other by a rod 55, fixed to the holes 53, 53*a*.

Slider 42 is applied to carriage 22 with the possibility of longitudinal sliding along it by means of slots 50, 52 engaging pegs 27', 27. "Longitudinal" means the lengthwise direction of tracks 14, 17, which is the direction of the door width. Slider 42 is bound to the tab 36 of connecting rod or lever 30, at hole 51, and slider 42*a* is bound to the tab 36*a* of connecting rod-lever 30*a*. The tabs 36, 36*a* cause the compensator unit to move rightwards, as shown in the figures, for a clockwise rotation of levers 30, 30*a*.

A spring 60 between a tab 21 of the carriage 22 and lug 46 of the slider urges the carriage unit 20 and the compensator unit 40 to a retracted condition.

The compensator unit 40 further includes a control/movement lever or cam means 70, that includes a triangular plate 71 with an idle roller 72. Plate 71 rotatably engages a peg 27', of the carriage 22 and has its peg 73 received in slot 47 of slider 42. The axes of roller 72, peg 27' and peg 73 are arranged at the vertices of a triangle.

When the mechanism is assembled, roller 72 engages a cam recess or groove 74 of the structure 12 for a sliding movement. The cam recess 74 is in communication with track 14 and, for a retracting door, has its axis inclined, from said track 14, towards the front and side of the mechanism. If it is desired to have door 2 assembled for an extraction opening movement so that it can slide open before adjoining door 4, the cam recess 74 inclination will be 90° with respect to the position shown in the drawings, i.e. extended from the track 14 in a sidewards direction and towards the wardrobe's rear portion. The shape of cam groove 74 is designed to offset exactly, if possible, the projection of the travel of pivot 32 of lever 30 in the door plane, upon rotation of the levers 30, 30*a*, and, if possible, during each moment of the travel.

Figure 5:
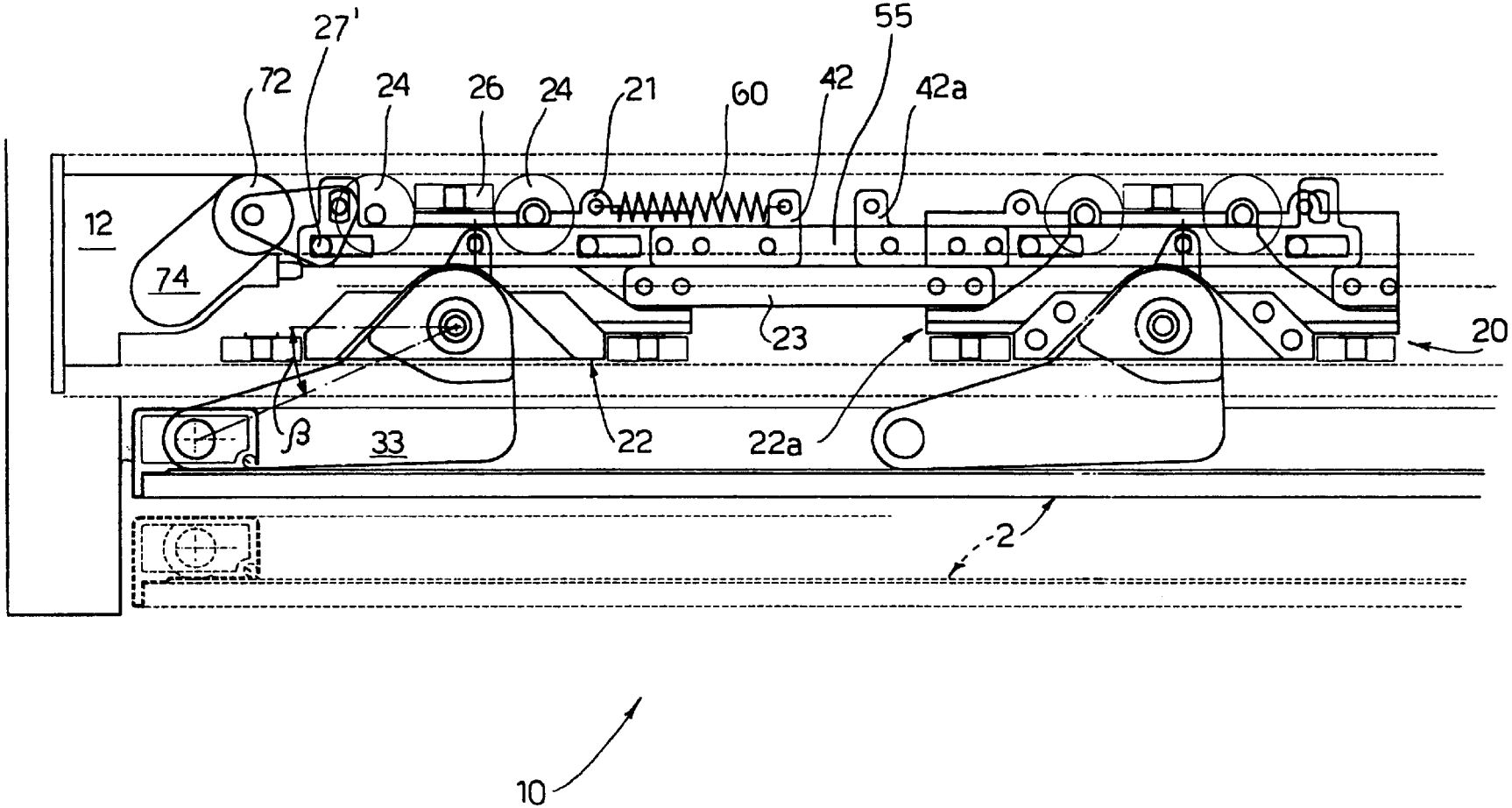
FIG. 5 is a similar illustration to FIG. 4, but the mechanism is shown in a retracted door position ready for sliding open; a door closed position is shown by the dash lines.
Figure 6:
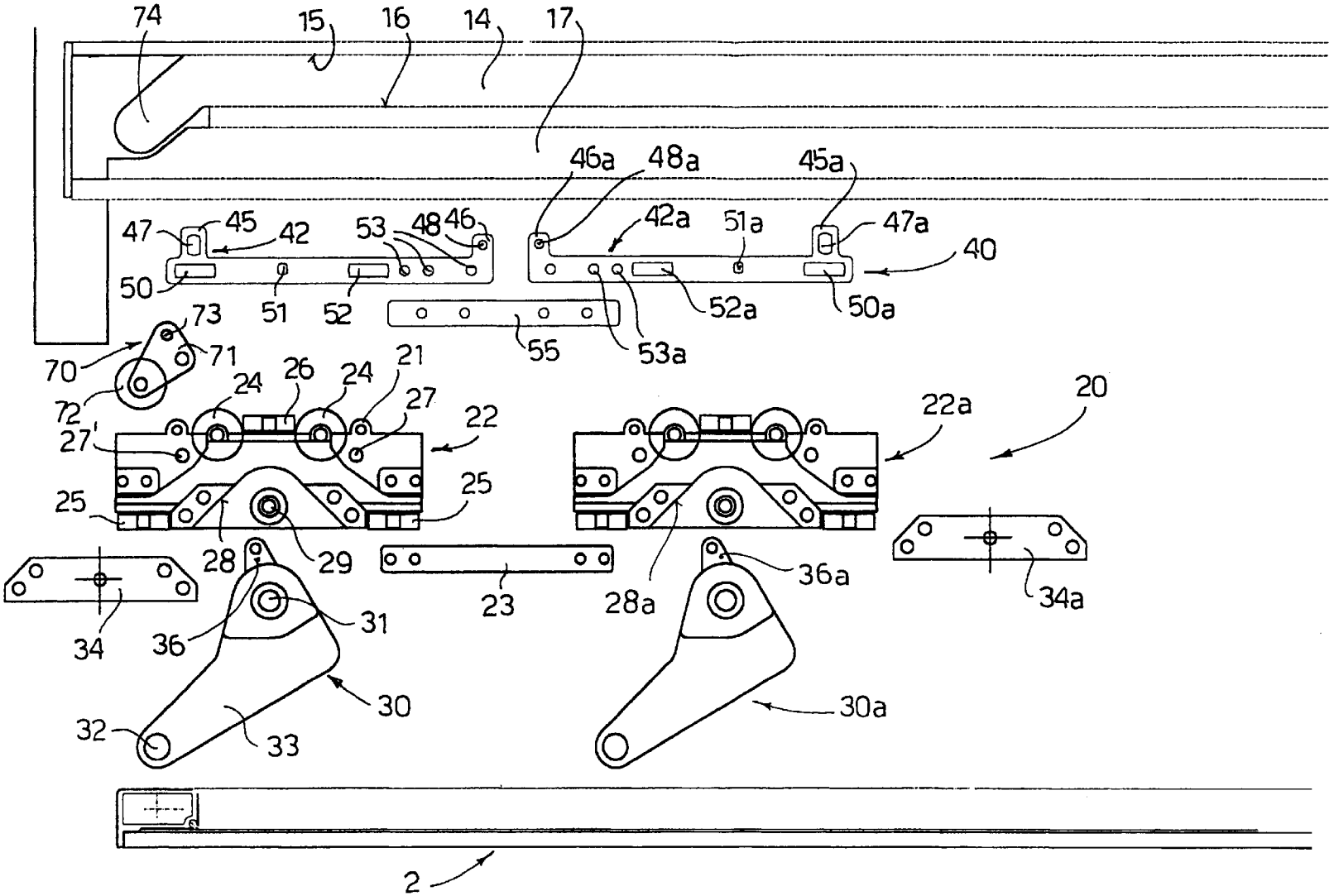
FIG. 6 is an exploded top plan view of the mechanism.

That is to say: assume that $l_{33}$ is the distance between axes $a_{31}$, $a_{32}$ of bearing 31 and pivot 32 of the connecting rod-lever 30, and a straight line joining the two axes in the plane of FIGS. 4 and 5, forms and angle $\alpha$ in the extended door condition and an angle $\beta$ in the retracted door condition with a vertical plane through axis of 31; should the carriages be held stationary, door 2, passing from its coplanar condition to its retracted condition, would undergo a leftwards shift of: $l_{33}$ COS $\beta - l_{33}$ cos $\alpha$, and, at each intermediate moment, a shift equal to $l_{33} \cos\gamma - l_{33} \cos\alpha$ with $\beta<\gamma<\alpha$. The collaboration of the cam system of roller 72 and recess 74 is such as to ensure, at all times, a rightwards shift or travel $x=1_{33}$ COS $\gamma - l_{33}$ COS $\alpha$, with $\gamma$ varying between $\alpha$ and $\beta$.

The operation of the mechanism will now be described in more detail. Door 2 with its frame $\mathbf{2}_1$ is assembled on pivots 32, 32*a* of an upper mechanism 10 and on similar pivots of a similar lower mechanism. A rigid bar (not shown) connects corresponding pivots, for instance, 32, of the two mechanisms. The bar is rigidly secured to the corresponding connecting rods 30, 30*a* next to the fulcrum or pivots 32, so that the connecting rods turn of a same angle. A rigid connection of bar and connecting rod is well within the reach of a person skilled in the art and therefore is not explained further. In its rest condition, shown in FIG. 4, spring 60 keeps the compensator unit in a retracted condition on the carriage unit; lever 30 and lever 30*a* of the four-bar linkage are in an extended condition in which door 2 is in its closing position, coplanar to adjacent door 4; roller 72 is at an end of recess 74. To open the door 2, the user pushes it, causing it to slide backwards parallel to itself until the condition shown in FIG. 5, and thus causes the levers 30, 30*a* to turn around their respective pivots, hence forcing the tabs 36, 36*a* to slide the compensator unit rightwards, as in the figures, against the action of spring 60. The sliding of the compensator unit rightwards drags the triangular plate 71 of the movement control lever 70 forcing the same to turn around the pivot 27'. The wheel 72 travels along cam recess 74 following a path defined by the recess walls, and forces the slider units bound thereto to shift rightwards. The shift is transferred to the carriage unit 20, through the tabs 36, 36*a*. Door 2 in the retracted condition in FIG. 5 can slide behind door 4. The retracted condition of door 2, for its entire longitudinal travel, is maintained by means of roller 72 engaging Track 14.

The operation of the mechanism will now be described in more detail. Door 2 with its frame $\mathbf{2}_1$ is assembled on pivots 32, 32*a* of an upper mechanism 10 and on similar pivots of a similar lower mechanism. A rigid bar (not shown) connects corresponding pivots, for instance, 32, of the two mechanisms. The bar is rigidly secured to the corresponding connecting rods 30, 30*a* next to the fulcrum points 32, so that the connecting rods turn of a same angle. A rigid connection of bar and connecting rod is well within the reach of a person skilled in the art and therefore is not explained further. In its rest condition, shown in FIG. 4, spring 60 keeps the compensator unit in a retracted condition on the carriage unit; lever 30 and lever 30*a* of the four-bar linkage are in an extended condition in which door 2 is in its closing position, coplanar to adjacent door 4; roller 72 is at an end of recess 74. To open the door 2, the user pushes it, causing it to slide backwards parallel to itself until the condition shown in FIG. 5, and thus causes the levers 30, 30*a* to turn around their respective pivots, hence forcing the tabs 36, 36*a* to slide the compensator unit rightwards, as in the figures, against the action of spring 60. The sliding of the compensator unit rightwards drags the triangular plate 71 of the movement control lever 70 forcing the same to turn around the pivot 27'. The wheel 72 travels along cam recess 74 following a path defined by the recess walls, and forces the slider units bound thereto to shift rightwards. The shift is transferred to the carriage unit 20, through the tabs 36, 36*a*. Door 2 in the retracted condition in FIG. 5 can slide behind door 4. The retracted condition of door 2, for its entire longitudinal travel, is maintained by means of roller 72 engaging track 14.

For closing movement, door 2 is slid leftwards until roller 72 enters the recess or groove 74, which allows rotation again, this time anti-clockwise, of levers 30 around the respective pivots under the action of spring 60.

It will be noticed that the device could easily be adapted for doors of various width simply by choosing rods 23 and 55 of suitable size.

Although the device has been described with particular reference to a lefthand door of retracting coplanar doors, with the same parts arranged in an identical way, it could easily be adapted for a righthand door. Besides, with appropriate modifications of groove 74, the device could be adapted to extraction opening coplanar doors.

What is claimed is:

1. A movement mechanism for sliding coplanar doors, said mechanism comprising: a structure, connecting rods arranged as a four-bar linkage, each having a distal pivot axis for assembly on a sliding door of said doors and another axis pivoted to a carriage, said carriage being movable on at least one track of said structure, able to slide said door behind the other door, a compensator unit providing a compensation travel of said carriage along the at least one track, said compensation travel being equal and opposite to a projection of an arc on a plane parallel to the door, said arc completed by a distal pivot axis of the connecting rods around a carriage pivot axis pivoted to a carriage upon the extraction or retraction of the door, said compensator unit including a tab extension on at least one of said connecting rods, said tab extension being opposite said distal pivot axis with respect to said carriage pivot axis;

at least one slider movable along said carriage and pivotally engaged with said tab extension, said slider being spring biased by a spring to a retracted condition with respect to said carriage; and cam means engaged for movement with said carriage and said at least one slider and cooperating with a cam groove in said structure.

2. A mechanism according to claim 1, wherein said cam means include a plate rotatably assembled to a carriage and carrying an idle roller engaging said cam groove in the structure, the plate being rotationally moved around a pivot of the carriage by engagement with the slider.

3. A mechanism according to claim 1, wherein the carriage includes vertical axis wheels and horizontal axis wheels for engaging said at least one track.

4. A mechanism according to claim 1, wherein a slider is engaged on said carriage by lengthwise slots of the slider engaged on carriage pegs.

5. A mechanism according to claim 1, wherein the cam groove in the structure communicates with a sliding track and has parallel guide walls inclined sidewards and towards the door, for a retracting door.

6. A mechanism according to claim 1, wherein the cam groove is in communication with the sliding track and said cam groove slants from the at least one sliding track sideways in a direction away from the door, for an extracting door.

7. A mechanism according to claim 1, wherein levers supporting the door extend from the structure.

8. A mechanism according to claim 1, wherein a carriage travel caused by the door's retraction or extraction has an extent substantially equal to the projection, on a door plane, of an arc traveled by a distal pivot axis around a lever pivot axis.

9. A movement assembly for sliding coplanar doors according to claim 1, further comprising a rigid a connection bar for an upper mechanism and a lower mechanism, rigidly secured to corresponding connecting rods of the upper mechanism and the lower mechanism.

10. An assembly according to claim 9, wherein said bar is rigidly secured to distal pivot points of the corresponding connecting rods.

* * * * *